US005166654A

United States Patent [19]

Doyelle

[11] Patent Number: 5,166,654

[45] Date of Patent: Nov. 24, 1992

[54] PERMANENT-MAGNET GRAB

[75] Inventor: Pierre Doyelle, Montmelian, France

[73] Assignee: Braillon Magnetique, Societe Anonyme, Montmelian, France

[21] Appl. No.: 861,071

[22] Filed: Mar. 31, 1992

[30] Foreign Application Priority Data

Apr. 10, 1991 [FR] France ..... 91 04604

[51] Int. Cl.[5] ..... H01F 7/02; H01F 7/20

[52] U.S. Cl. ..... 335/288; 335/295

[58] Field of Search ..... 269/8; 335/285-295, 335/296, 297, 298, 306, 302

[56] References Cited

U.S. PATENT DOCUMENTS

| | | | |
|---|---|---|---|
| 2,268,011 | 12/1941 | Beechlyn | 335/285 |
| 2,333,230 | 11/1943 | Beechlyn | 335/285 |
| 2,347,023 | 4/1944 | Beechlyn | 335/285 |
| 2,435,735 | 2/1948 | Briggs | 335/295 |
| 2,832,932 | 4/1958 | Baermann | 335/306 |
| 3,452,310 | 6/1969 | Israelson | 335/295 |
| 3,588,768 | 6/1971 | Baermann | 335/306 |
| 3,812,629 | 5/1974 | Campbell | 335/295 |
| 4,122,922 | 10/1978 | Baermann | 188/267 |
| 4,250,478 | 2/1981 | Cardone et al. | 335/288 |
| 4,251,791 | 2/1981 | Yanagisawa et al. | 335/302 |
| 4,314,219 | 2/1982 | Haraguchi | 335/295 |
| 4,329,673 | 5/1982 | Uchikune et al. | 335/288 |
| 4,393,363 | 7/1983 | Iwasaki | 335/288 |
| 4,465,993 | 8/1984 | Braillon | 335/287 |
| 4,482,034 | 11/1984 | Baermann | 335/306 |

FOREIGN PATENT DOCUMENTS

| | | |
|---|---|---|
| 0090746 | 10/1983 | European Pat. Off. . |
| 2704118 | 11/1977 | Fed. Rep. of Germany . |
| 1569915 | 6/1969 | France . |
| 2441577 | 6/1980 | France . |

*Primary Examiner*—Leo P. Picard
*Assistant Examiner*—Raymond Barrera
*Attorney, Agent, or Firm*—Herbert Dubno; Andrew Wilford

[57] ABSTRACT

A magnetic grab has a pair of pole pieces each forming a downwardly directed pole and formed adjacent the respective poles with horizontally extending semicylindrical seats having approximately the same center of curvature and open concavely inward toward each other. One of the pieces has an upwardly directed upper surface to one side of the seats and the other piece has a lower surface directed downward at the upper surface and also to the one side of the seats. A rotor fitting in the seats is provided with a plurality of high-flux rotor magnets polarized about respective axes extending generally diametrically of the rotor axis. At least one low-flux permanent magnet having a vertical polarization axis between the upper and lower surfaces has its north pole engaging one of the surfaces and its south pole engaging the other surface. The rotor can be turned about its axis between an inactive position with the north poles of the rotor magnets turned toward the seat of the piece having the other surface and the south poles of the rotor magnets turned toward the seat of the piece having the one surface, and an active position with the north poles of the rotor magnets turned toward the seat of the piece having the one surface and the south poles of the rotor magnets turned toward the seat of the piece having the other surface.

8 Claims, 3 Drawing Sheets

PERMANENT-MAGNET GRAB

FIELD OF THE INVENTION

The present invention relates to a grab. More particularly this invention concerns a switchable permanent magnet grab.

BACKGROUND OF THE INVENTION

A standard magnetic grab such as described in French patent document 2,441,577, German patent document 2,704,118 and European patent application 90,746 normally has two groups of permanent magnets each having a lower surface sitting atop a respective pole piece and an upper surface bridged by a piece of mild steel, forming in effect a downwardly pointing U-magnet. The magnets in one leg are polarized oppositely to those in the other leg so that one of the pole pieces is the north pole and the other the south pole of the magnet. A rotor situated between the legs of this symmetrical magnet can be rotated to juxtapose its north pole with the north-pole leg and its south pole with the south-pole leg in an active position to add together the magnetic fields and to make the grab capable of lifting a magnetically attractable object engaged with the pole pieces. When reversed, with the rotor north pole turned toward the south-pole leg and the rotor south pole turned toward the north-pole leg, all flux flows between the two legs through the rotor and the grab has no appreciable lifting capacity.

Such an arrangement is fairly tall so that it has a high center of gravity and therefore can be fairly difficult to use. In addition it has a fairly small footprint so that lifting a large object with it requires that it be carefully centered on the object.

It has been suggested in copending application 07/816,736 filed Jan. 3, 1992 to provide a magnetic grab with an even number of main permanent magnets in an annular array with each magnet horizontally polarized and having a north pole and a south pole with each pole spacedly angularly juxtaposed with the pole of the same polarity of the adjacent magnet. Respective magnetically permeable pole pieces are angularly interleaved with the magnets so that the pieces between north poles are polarized north and the pieces between south poles are polarized south. A magnetically permeable horizontal plate is spaced above the pole pieces and a nonmagnetic disk is rotatable about the axis immediately above the magnets and pieces and below the plate and has angularly spaced zones in the same even number as the pole pieces. A switching permanent magnet on the disk in each zone is vertically polarized with the magnet of each zone polarized vertically oppositely to the switching magnets of the angularly adjacent zones. The disk is movable between an active position with the north poles of a first half of the switching magnets turned toward the north-polarized pole pieces and the south poles of a second half of the switching magnets turned toward the south-polarized pole pieces and an inactive position with the poles oppositely oriented. Thus in the active position the fields of the main magnets are depressed by those of the switching magnets below the pole pieces and in the inactive position the magnetic flux of the main magnets is shunted mainly through the plate.

Such an arrangement is a substantial improvement, but is still fairly complex.

OBJECTS OF THE INVENTION

It is therefore an object of the present invention to provide an improved permanent-magnet grab.

Another object is the provision of such an improved permanent-magnet grab which overcomes the above-given disadvantages, that is which is very compact and still of very simple construction.

SUMMARY OF THE INVENTION

A magnetic grab according to the invention has a pair of pole pieces each forming a downwardly directed pole and formed adjacent the respective poles with horizontally extending semicylindrical seats having approximately the same center of curvature and open concavely inward toward each other. One of the pieces has an upwardly directed upper surface to one side of the seats and the other piece has a lower surface directed downward at the upper surface and also to the one side of the seats. A rotor fitting in the seats is centered on and rotatable about a rotor axis extending horizontally parallel to and between the seats and is provided with a plurality of high-flux rotor magnets polarized about respective axes extending generally diametrically of the rotor axis. At least one low-flux permanent magnet having a vertical polarization axis between the upper and lower surfaces has its north pole engaging one of the surfaces and its south pole engaging the other surface. The rotor can be turned about its axis between an inactive position with the north poles of the rotor magnets turned toward the seat of the piece having the other surface and the south poles of the rotor magnets turned toward the seat of the piece having the one surface, and an active position with the north poles of the rotor magnets turned toward the seat of the piece having the one surface and the south poles of the rotor magnets turned toward the seat of the piece having the other surface.

Thus this arrangement is vertically relatively short yet still has, relative to its height, a wide footprint for most effective gripping. It can be operated easily and is of very simple construction.

According to the invention the one pole piece is a block of mild steel forming the upper surface and respective seat. The other pole piece is at least one block of mild steel of L-section having a vertical leg forming the respective seat and pole and a horizontal leg extending over the rotor and forming the lower surface. This other pole piece is normally made of two blocks of mild steel, one forming each leg of the other pole piece.

The rotor itself comprises two part-cylindrical ferromagnetic bars extending parallel to the axis and sandwiching the high-flux magnets. When the two bars are substantially identical the rotor is movable through about 180 between its positions. When one of the bars is substantially larger than the other bar the rotor is movable through substantially less than 180° between its positions. In both situations the part-cylindrical seats are centered on a common axis which is the axis of rotation of the rotor, and seat of the seat of the one pole piece is formed in its corner while the other seat is formed in the middle of the side of the respective pole piece, that is symmetrical to a horizontal plane including the rotor axis.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
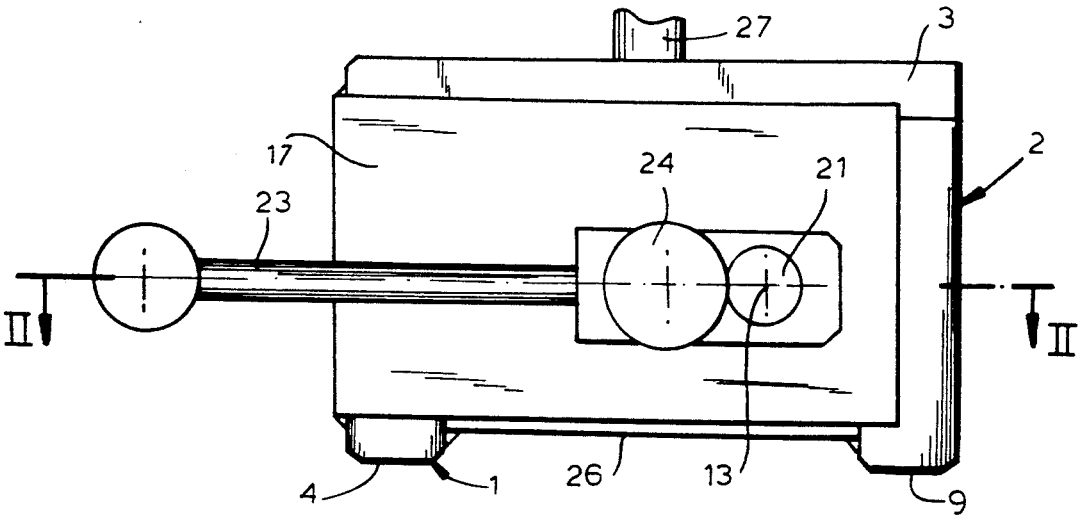
FIG. 1 is a side view of the grab according to the invention.
Figure 2:
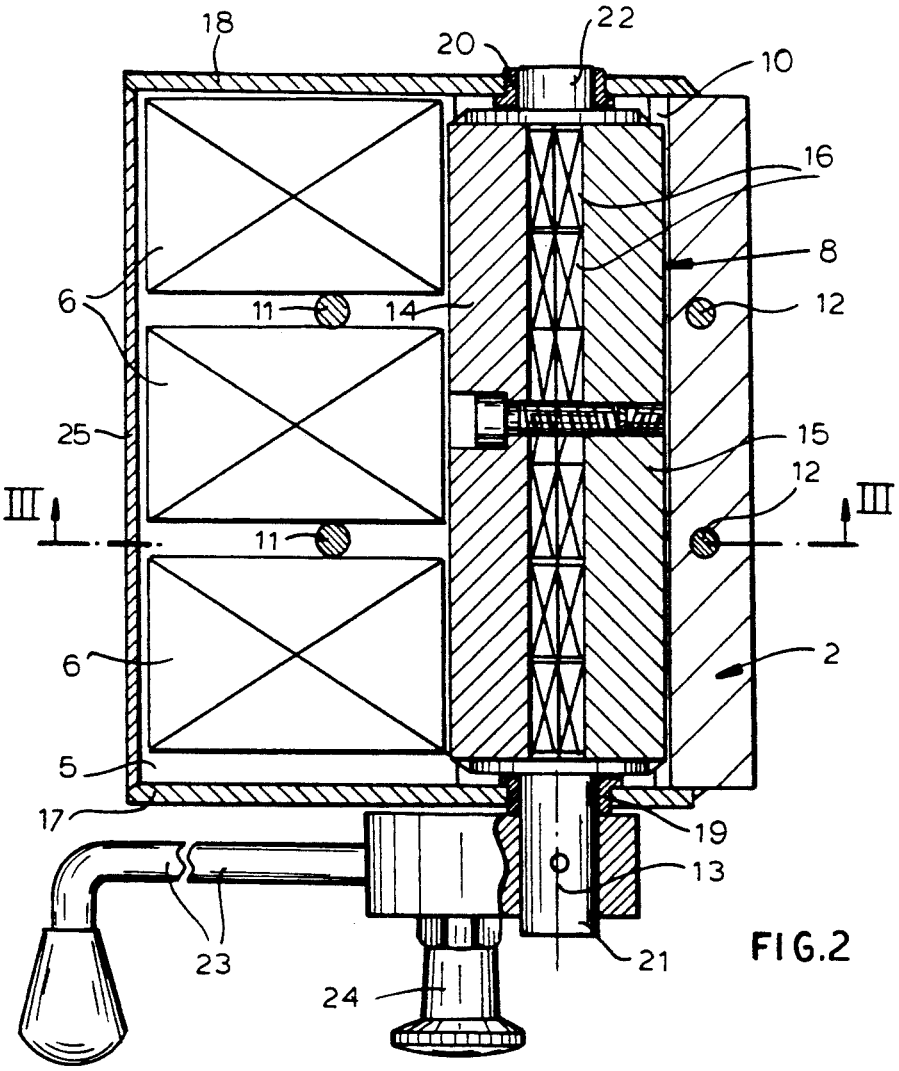
FIG. 2 is a section taken along line II—II of FIG. 1.
Figure 3:
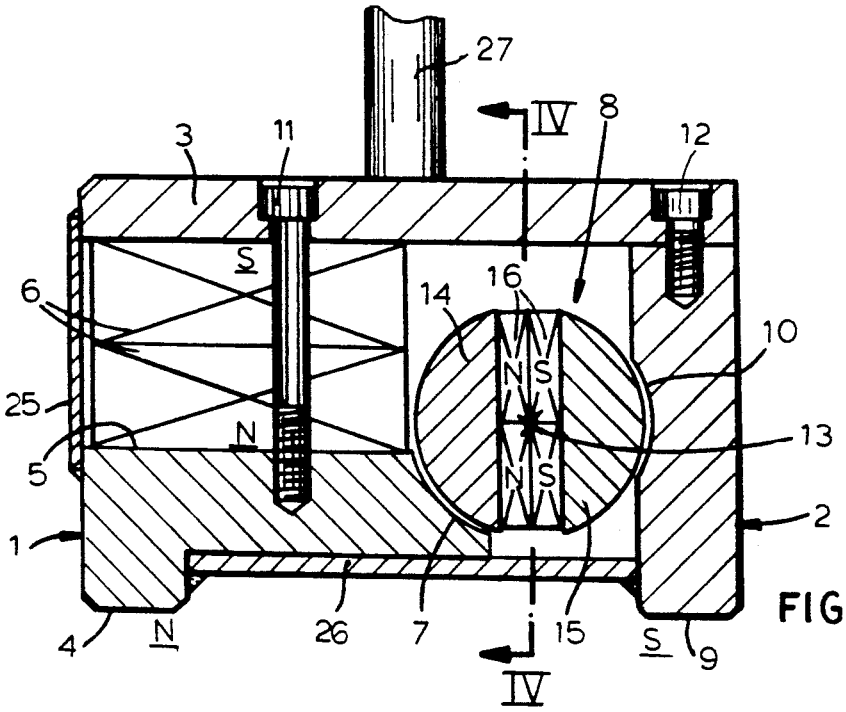
FIG. 3 is a section taken along line III—III of FIG. 2.

As seen in FIGS. 1 through 4 a permanent-magnet grab according to the invention basically comprises a first pole piece 1, a second pole piece 2, a bridge piece 3, a stack of low-flux ferrite magnets 6, and a rotor 8.

The first piece 1 has a lower protuberance forming a first downwardly directed pole surface 4 and an upper surface 5 on which sits the array of magnets 6. These magnets 6 number nine and are arranged in three piles of three each, sandwiched between one side of the lower surface of the plate 3 and the upper surface 5, with bolts 11 holding the assembly together. The other pole piece 2 is formed as a vertically oriented flat bar or plate having a lower edge forming the other pole or lifting surface 9 of the grab and an upper edge to which the plate 3 is secured by bolts 12. The elements 1, 2, and 3 are all made of mild steel or other highly magnetically permeable material. The magnets 6 have vertical polarity axes and have are of a relatively weak volumetric magnetic energy of about 30 kilojoules per cubic meter. The piece 1 is formed on its inner edge with a part-cylindrical recesses or seat 7 having a center of curvature at horizontal axis 13 and the piece 10 has an inner surface similarly formed with a part-cylindrical seat with a center of curvature at 13.

The rotor 8 is centered on the axis 13 and comprises two part cylindrical bars 14 and 15 sandwiching a stack of twenty high-flux rare-earth magnets 16 whose polarity axes extend perpendicular to a plane including the axis 13. These magnets 16 have a high volumetric magnetic energy of about 200 kilojoules per cubic meter, almost seven times the strength as the magnets 6. Pins 21 and 22 projecting axially from ends of the rotor 8 are received in low-friction bushings 19 and 20 set in end plates 17 and 18 of the grab. A handle 23 is fixed to the pin 21 and is provided with a latch 24 that can lock the rotor in the angular position shown in FIGS. 1 and 2 which is the active or lifting position of the grab.

The grab has a housing formed by the two nonmagnetic plates 17, a nonmagnetic side plate 25 extending vertically between the pieces 1 and 3, and a nonmagnetic bottom plate 26 extending horizontally between the lifting ridges 4 and 9 so that the rotor 8 is wholly enclosed. The top of the grab is provided with a lift eye 27.

Figure 4:
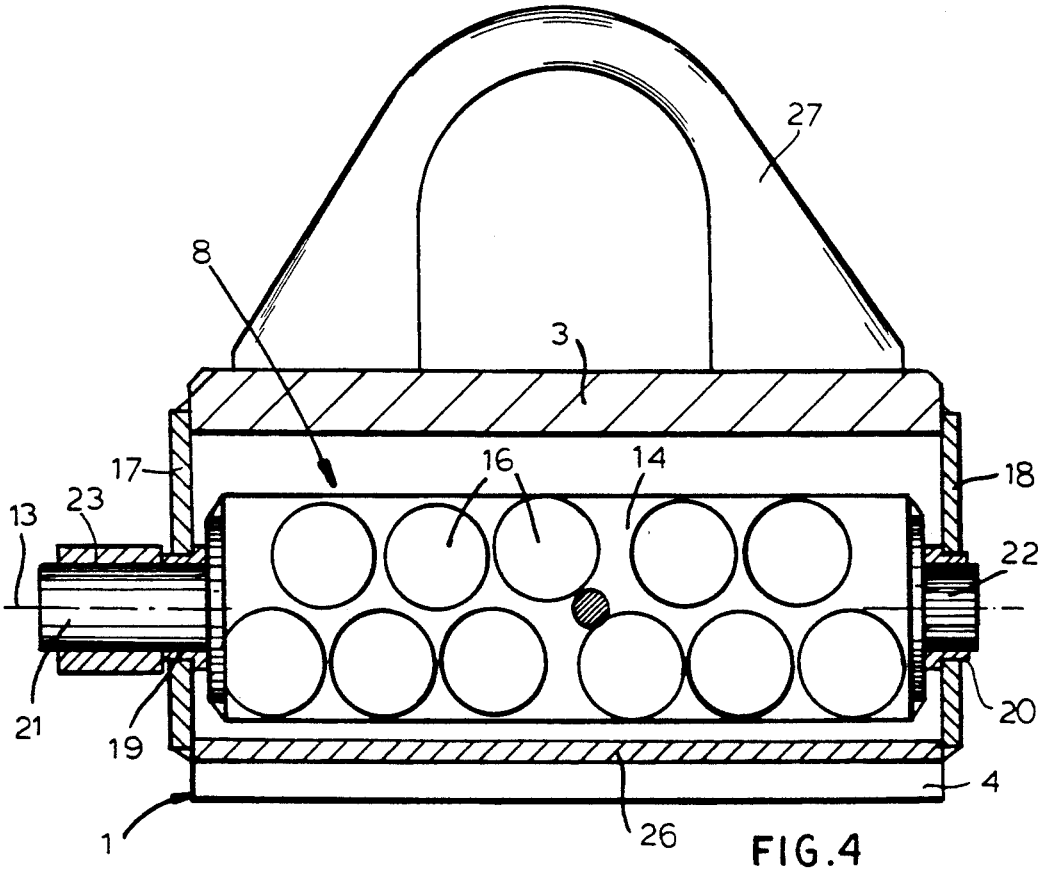
FIG. 4 is a section taken along line IV—IV of FIG. 3.

In the position of FIGS. 1 and 4 the north poles of the rotor magnets 16 are turned toward the lower north poles of the magnets 6 sitting on the lower pole piece 1 and the south poles of the magnets 16 are turned toward the seat 10 in the other pole piece 2. Thus the fluxes of these two sets of magnets 6 and 16 will be additive and any magnetically attractable object engage against the poles 4 and 9 will be attracted powerfully to the grab so it can be lifted.

If the position of the rotor 8 is reversed by 180° so that the orientation of the poles of the magnets 16 is reversed, the north poles of the magnets 16 will be juxtaposed with the north pole piece 1 and the south poles with the south pole piece 9. The rotor 8 will in this position form a magnetic short circuit between the two pole pieces 4 and 9 and virtually no flux will flow in the air below them. Thus the grab will be substantially unable to lift anything.

Figure 5:
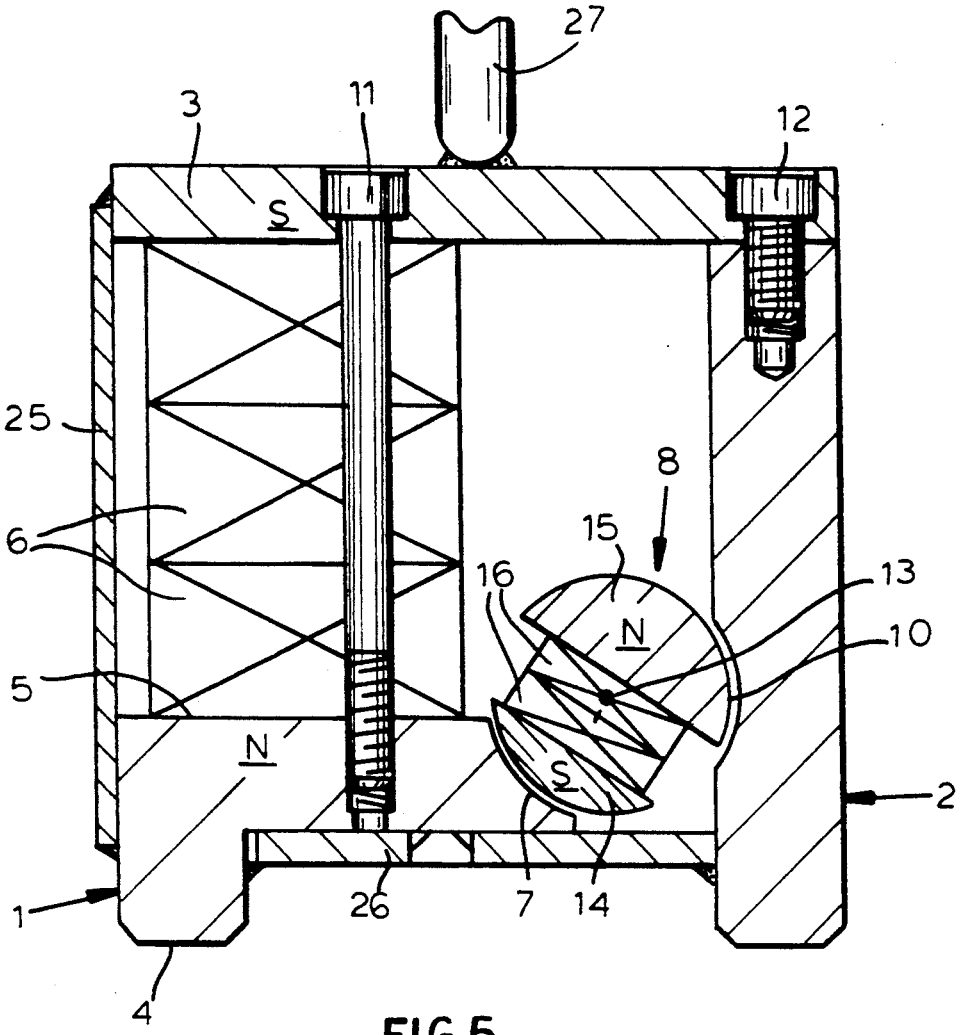
FIG. 5 is a view like FIG. 3 of another arrangement according to the invention.
Figure 6:
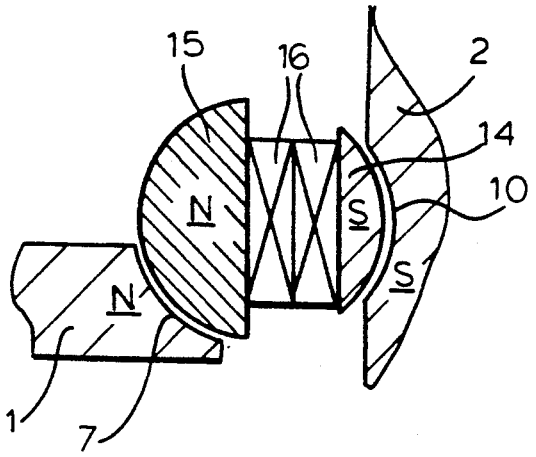
FIG. 6 is a view of a detail of FIG. 5 in another operative position.

In the arrangement of FIGS. 5 and 6 the pole piece 15′ of the rotor 8′ is much bigger than the pole piece 14 so that the magnets 16 are positioned offcenter from the rotor axis 13. With this system an angular displacement of substantially less than 180° is sufficient to reverse positions of the grab.

The instant invention is not limited to the embodiments described above. The size, number, and shapes of the various magnets can be changed considerably without leaving the scope of the invention. The two elements 2 and 3 could be instead a single L-section piece of mild steel. The two poles 4 and 9 could be differently shaped to fit to different objects to be lifted, for instance they could both lie on an imaginary cylinder whose axis is below the grab to engage barrels or the like. Similarly this system could be used to anchor tools or the like instead of as a lift-type grab.

I claim:

1. A magnetic grab comprising:

a pair of pole pieces each forming a downwardly directed pole and formed adjacent the respective poles with horizontally extending semicylindrical seats having approximately the same center of curvature and open concavely inward toward each other, one of the pieces having an upwardly directed upper surface to one side of the seats and the other piece having a lower surface directed downward at the upper surface and also to the one side of the seats;

a rotor fitting in the seats, centered on and rotatable about a rotor axis extending horizontally parallel to and between the seats, and provided with a plurality of high-flux rotor magnets polarized about respective axes extending generally diametrically of the rotor axis;

at least one low-flux permanent magnet having a vertical polarization axis between the upper and lower surfaces and having its north pole engaging one of the surfaces and its south pole engaging the other surface; and means for rotating the rotor between an inactive position with the north poles of the rotor magnets turned toward the seat of the piece having the other surface and the south poles of the rotor magnets turned toward the seat of the piece having the one surface, and an active position with the north poles of the rotor magnets turned toward the seat of the piece having the one surface and the south poles of the rotor magnets turned toward the seat of the piece having the other surface.

2. The magnetic grab defined in claim 1 wherein the one pole piece is a block of mild steel forming upper surface and respective seat.

3. The magnetic grab defined in claim 2 wherein the other pole piece is at least one block of mild steel of L-section having a vertical leg forming the respective seat and pole and a horizontal leg extending over the rotor and forming the lower surface.

4. The magnetic grab defined in claim 3 wherein the other pole piece is formed by two blocks of mild steel, one forming each leg of the other pole piece.

5. The magnetic grab defined in claim 1 wherein the rotor comprises two ferromagnetic bars extending parallel to the axis and sandwiching the high-flux magnets.

6. The magnetic grab defined in claim 5 wherein the two bars are substantially identical and the rotor is movable through about 180° between its positions.

7. The magnetic grab defined in claim 5 wherein one of the bars is substantially larger than the other bar and the rotor is movable through substantially less than 180° between its positions.

8. A magnetic grab comprising:

a first mild-steel pole piece forming a downwardly directed pole, a laterally directed semicylindrical seat, and an upwardly directed support upper surface laterally adjacent the seat;

a second mild-steel pole piece forming a downwardly directed second pole adjacent the first pole, a semicylindrical seat open laterally concavely toward the first seat, and a downwardly directed lower surface directly above the upper surface and laterally offset from the seats;

a rotor fitting in the seats, centered on and rotatable 12 about a rotor axis extending horizontally parallel to and between the seats, and provided with a plurality of high-flux rotor magnets polarized about respective axes extending generally diametrically of the rotor axis;

at least one low-flux permanent magnet having a vertical polarization axis engaged between the upper and lower surfaces and having its north pole engaging one of the surfaces and its south pole engaging the other surface; and means for rotating the rotor between an inactive position with the north poles of the rotor magnets turned toward the seat of the piece having the other surface and the south poles of the rotor magnets turned toward the seat of the piece having the one surface, and an active position with the north poles of the rotor magnets turned toward the seat of the piece having the one surface and the south poles of the rotor magnets turned toward the seat of the piece having the other surface.

* * * * *